US009834924B2

(12) United States Patent
Lopez et al.

(10) Patent No.: US 9,834,924 B2
(45) Date of Patent: Dec. 5, 2017

(54) SEISMIC DAMAGE REDUCING SYSTEM FOR PARTITIONS

(71) Applicant: SINIAT INTERNATIONAL SAS, Avignon (FR)

(72) Inventors: Pauline Lopez, Avignon (FR); Roger Arese, Isle sur la Sorgue (FR); Emmanuel Vial, Nimes (FR); Crescenzo Petrone, San Felice a Cancello (IT); Gennaro Magliulo, Rome (IT)

(73) Assignee: Etex Building Performance International SAS, Avignon (FR)

( * ) Notice: Subject to any disclaimer, the term of this patent is extended or adjusted under 35 U.S.C. 154(b) by 0 days.

(21) Appl. No.: 15/105,203

(22) PCT Filed: Dec. 19, 2014

(86) PCT No.: PCT/EP2014/078834
§ 371 (c)(1),
(2) Date: Jun. 16, 2016

(87) PCT Pub. No.: WO2015/092001
PCT Pub. Date: Jun. 25, 2015

(65) Prior Publication Data

US 2016/0333575 A1 Nov. 17, 2016

(30) Foreign Application Priority Data

Dec. 20, 2013 (EP) ..... 13290324

(51) Int. Cl.
*E04B 1/98* (2006.01)
*E04B 2/82* (2006.01)
*E04H 9/02* (2006.01)

(52) U.S. Cl.
CPC ..... *E04B 1/98* (2013.01); *E04B 2/828* (2013.01); *E04H 9/02* (2013.01); *E04H 9/021* (2013.01)

(58) Field of Classification Search
CPC ... E04B 1/98; E04B 2/828; E04H 9/02; E04H 9/021
(Continued)

(56) References Cited

U.S. PATENT DOCUMENTS 6,247,275 B1 * 6/2001 Taylor ..... E04H 9/02 52/167.1
2001/0045069 A1 * 11/2001 Constantinou ..... E04H 9/02 52/167.3
(Continued)

FOREIGN PATENT DOCUMENTS

WO 2013/010769 A1 1/2013

*Primary Examiner* — Charles A Fox
*Assistant Examiner* — James Buckle, Jr.
(74) *Attorney, Agent, or Firm* — Dilworth & Barrese, LLP

(57) ABSTRACT

Seismic damage reducing system for partitions. A seismic protective structure (100) for forming part of a board partition (190) and for limiting damage to the board partition (190) when a given level of seismic stress is appearing, is described. The seismic protective structure (100) comprising a breaking mechanism (107) introduced near an upper corner and/or lower corner of board partition (190), wherein the breaking mechanism (107) is adapted for, when a given level of seismic stress is appearing, intentionally causing damage of the board partition (190) thereby releasing stress from the remainder of the board partition (190).

21 Claims, 4 Drawing Sheets

(58) Field of Classification Search
USPC ..... 52/100
See application file for complete search history.

(56) References Cited

U.S. PATENT DOCUMENTS

| | | | | |
|---|---|---|---|---|
| 2002/0095879 | A1* | 7/2002 | Fanucci | E04H 9/02 52/167.3 |
| 2005/0257451 | A1* | 11/2005 | Pryor | E04B 1/2403 52/167.4 |
| 2006/0137292 | A1 | 6/2006 | Nakamura et al. | |
| 2013/0174501 | A1* | 7/2013 | Michael | F16F 9/303 52/167.1 |
| 2014/0360108 | A1* | 12/2014 | Fujiu | F16F 15/04 52/167.7 |
| 2015/0233113 | A1* | 8/2015 | Ueno | E04B 1/98 52/167.1 |
| 2016/0319539 | A1* | 11/2016 | Lopez | E04B 2/828 |

* cited by examiner

SEISMIC DAMAGE REDUCING SYSTEM FOR PARTITIONS

FIELD OF THE INVENTION

The present invention relates to the field of board partitions. More specifically it relates to a protective structure for limiting damage to board partitions caused by earthquakes.

BACKGROUND OF THE INVENTION

In earthquake sensitive regions, buildings are often designed and constructed to withstand earthquake movements or to reduce the damage to their outside construction caused by such earthquake movements. Earthquake movements can be up and down movements as well as side to side movements. They can come in waves. Whereas a lot of attention has been given to design and construction of the outside structure of buildings, also the inner walls typically get damaged during earthquakes. Inner walls typically may be constructed as board partitions, which are built using a sub-structure made of e.g. wood or metal studs, on which boards are mounted. During an earthquake these board partitions can break due to forces on the board partitions. More particularly, movements of the building during an earthquake typically may induce deformation of the sub-structure of the partition, resulting in damage to both the board wall as well as to the underlying sub-structure.

Japanese patent application JP06001520 describes one solution for reducing damage to a partition by adjusting the connection of the partition with other walls that induce stress on the partition during earthquakes. The connection is made using a linking device having an accordion-like structure allowing relative movement between the inner walls. In some particular embodiments, the linking device may be an attachment/detachment device that links the walls but that can be released when a predetermined force or larger is applied, e.g. during an earthquake. The linking device might for example be a door that is kept close using magnets and that opens when a too large force is applied.

Another solution is to construct the board partition structure freely from the remaining building structure, i.e. by leaving gaps between the partition structure and the remaining building structure. The space (deflection gap) between both typically then is filled with a flexible joint. This method works well for small earthquakes, but if the movements of the building surpass the space filled with the flexible joints, the partition structure will eventually break.

There is still room for improving board partitions for use in earthquake sensitive regions so as to limit the damage caused by earthquakes thereto.

SUMMARY OF THE INVENTION

It is an object of the present invention to provide a system and method for limiting damage to board partitions so as to prevent breaking or damaging of entire board partitions when stress is applied to it, e.g. during earthquakes.

It is an advantage of embodiments of the present invention that even when high levels of stress are induced by an earthquake, only a small portion of the board partition will be damaged and thus will need to be replaced or restored.

It is an advantage of embodiments of the present invention that during earthquakes breaking of the corners of a seismic protective results in releasing the remainder board partition from the high stresses induced by the earthquake and thus avoiding breaking. Breaking corner pieces of boards in a seismic protective structure thus removes stress or pressure at the rest of the board partition thereby avoiding damage over the complete board partition.

It is an advantage of embodiments of the present invention that a reliable solution is provided for avoiding damage to a complete board partition during earthquakes, whereby the risk of failure of the system, e.g. during subsequent earthquakes, is reduced or avoided. It thereby is an advantage of embodiments of the present invention that after an earthquake with a given seismic level, the damaged protective structure can be replaced, thus avoiding that mechanical parts of a re-usable seismic protective would be damaged without noticing it, causing safety issues as this may hamper proper functioning.

The above objective is accomplished by a method and device according to the present invention.

The present invention relates to a seismic protective structure for forming part of a board partition and for limiting damage to the board partition when a given level of seismic stress is appearing.

Such seismic protective structure for forming part of a board partition and for limiting damage to the board partition when a given level of seismic stress is appearing, comprises a breaking mechanism introduced near an upper corner and/or lower corner of board partition, wherein the breaking mechanism is adapted for, when a given level of seismic stress is appearing, intentionally causing damage of the board partition thereby releasing stress from the remainder of the board partition.

The seismic protective structure according to the invention comprises:

at least one board, a first substantially vertical support element for connecting the at least one board thereto and for positioning the at least one board at the of the board partition adjacent an adjacent wall neighboring the board partition, a track element being connectable to the adjacent wall neighboring the board partition, the track element being adapted for moveably positioning the first substantially vertical support element therein, a second substantially vertical support element for linking the at least one board with the remainder of the board partition, the seismic protective structure comprising a breaking mechanism introduced near an upper corner and/or lower corner of the at least one board, wherein the breaking mechanism is adapted for, when a given level of seismic stress is appearing, intentionally causing damage to the upper corner and/or lower corner of the board partition thereby releasing stress from the remainder of the board partition.

According to a first aspect of the invention, a seismic protective structure is provided. The seismic protective structure is suitable for forming part of a board partition, the seismic protective structure comprises:

at least one board, a first support element for connecting the at least one board thereto and for positioning the at least one board such that said board provides at least one of the upper corner and lower corner of the board partition adjacent an adjacent wall neighboring the board partition, a track element being connectable to the adjacent wall neighboring the board partition, the track element being adapted for moveably positioning the first support element therein, a second support element for linking the at least one board with the remainder of the board partition, the seismic protective structure comprising at least one breaking mechanism located adjacent said upper corner and/or lower corner of the board partition provided by said at least one board, wherein the breaking mechanism is adapted for, when a given level of seismic stress is appearing, intentionally causing damage to the at least one board at said upper corner and/or lower corner of the board partition, thereby releasing stress from the remainder of the board partition.

The seismic protective structure may be adapted for, when a given level of seismic stress is appearing, intentionally causing damage of at least a first board at one side of the board partition, and of at least a second board at the other, opposite side of the board partition, thereby releasing stress from the remainder of the board partition, more particular releasing stress from the remainder of the boards at both sides of the board partition.

In case the seismic protective structure is to cause damage to only one side of the board partition, and to only the upper or lower corner of the board partition, the board partition may comprise 8 such seismic protective structures, one such structure for each side in each of said corners. In case the seismic protective structure is to cause damage to both sides of the board partition, but to only the upper or lower corners of the board partition, the board partition may comprise 4 such seismic protective structures, one such structure for each of said corners. In case the seismic protective structure is to cause damage to only one of the sides sides of the board partition, but to both the upper and lower corners of the board partition, the board partition may comprise 4 such seismic protective structures, one such structure for each side and each pair of upper or lower corners.

The at least one board partition may preferably be a gypsum board partition.

According to some embodiments, the at least one board may provide both the upper corner and lower corner of the board partition adjacent an adjacent wall neighboring the board partition.

According to some embodiments, the seismic protective structure may comprise at least a first and a second board, the first board providing the upper corner of the board partition adjacent an adjacent wall neighboring the board partition, the second board providing said lower corner of the board partition adjacent an adjacent wall neighboring the board partition.

According to some embodiments, the seismic protective structure may comprise at least a first and a second breaking mechanism, the first breaking mechanism is adapted for, when a given level of seismic stress is appearing, intentionally causing damage to the at least one board at the upper corner of the board partition, the second breaking mechanism is adapted for, when a given level of seismic stress is appearing, intentionally causing damage to the at least one board at the lower corner of the board partition thereby releasing stress from the remainder of the board partition.

According to some embodiments, each of the at least one breaking mechanisms may be adapted to cause damage in a square zone of the board partition, this square zone having as one of its corners one of the upper and lower corner of the board partition, and a side equal to 0.2*H, H being the maximum height of the board partition.

According to some embodiments, each of the at least one breaking mechanisms may be adapted to cause damage in a square zone of the board partition, the square zone having as one of its corners one of the upper and lower corner of the board partition, and a side equal to 0.2*H, or even $0.2*H/\sqrt{2}$, H being the maximum height of the board partition.

According to some embodiments, the acute angle between the axes of the first and second support element be less than 20°, typically less than 15°, such as less than 10°.

According to some embodiments, the first and second support element may be substantially parallel. Substantially parallel is to be understood as will the acute angle between the axes of these support elements be less than 5°.

The board may be an edge board, i.e. a board positioned at the edge of the board partition, but the invention is not limited thereto and can also relate to a system and method for breaking a board at another position in the partition board.

It is an advantage of embodiments of the present invention that the corners of the board partition will damage, e.g. break or open, at smaller levels of stress, e.g. at smaller displacement caused by seismic activity, than the remainder part of the partition structure will do, thus removing pressure from the rest of the board partition thereby avoiding damage over the complete board partition and only introducing damage in the seismic protective structure.

It is an advantage of embodiments of the present invention that correct operation is guaranteed even after a number of earthquakes. In embodiments of the present invention the corners of the board partition breaks if the energy build up in the board partition exceeds a certain limit. This prevents pressure to build up in the remainder part of the partition structure causing it to break. In this way, it can be avoided that boards or support elements in the remainder part cause damage to the environment due to failure. It is an advantage that after breaking of the corners of the partition board, the board is the weakest board in the board partition. If, after breaking of the corners, the earthquake continues, the damaged corners of the board partition will break as first before the rest of the board partition. Thereby pressure will be released from the rest of the board partition, preventing the rest of the board partition from breaking.

The one or more breaking mechanism may comprise a force exercising means suitable for exercising a force to the board, the angle between the force exercised and an axis orthogonal to the surface of the board being in the range of 50° to 0°, the force exercising means being adapted for triggering the exercising of said force when a given level of seismic stress is appearing on the board partition.

The breaking mechanism may, as an example of a force exercising means, comprise an expansion means for expanding and introducing stress at the upper corner and/or lower corner of the board partition, said expansion means being adapted for triggering the expanding when a given level of seismic stress is appearing on the board partition.

It is an advantage of embodiments of the current invention that during an earthquake the breaking mechanism induces a force on the upper and/or lower corner of the board partition which causes the upper and/or lower corner to break before the rest of the boards in the board partition breaks. The breaking mechanism applies its pressure on the board partition on a position where the seismic pressure is already higher than the average seismic pressure in the board partition. Moreover the seismic movement is converted into a force substantially orthogonal to the board partition. The angle between the applied force and a vector orthogonal to the board partition may be between 0° and 90° preferably between 50° and 0°, such as between 45° and 0°. Applying the breaking mechanism on these parts of the board partition which have already a high seismic pressure is effective for breaking these parts before any other part of the board partition gets broken.

The expansion means may comprise rotatable arms orienting in a direction perpendicular to the at least one board partition, such as a gypsum board partition, when a given level of seismic stress is appearing on the board partition.

The breaking means may be fixed at one side to the track element in a first fixation point and at two opposing boards in further fixation points, so that, when a given level of seismic stress is appearing, the rotatable arms are expanding due to forces induced on the breaking means between the different fixation points.

The breaking means may comprise a first arm connected to the first fixation point and a second and third arm hingedly connected to the first arm in a same hinging point, the second and the third arm respectively connected to the opposing boards in the further fixation points.

The breaking means may be fixed at one side to the track element in a first fixation point and at another side to a bottom or top part of the board partition in a further fixation point, so that, when a given level of seismic stress is appearing, the rotatable arms are expanding due to forces induced on the breaking means between the first fixation point and the further fixation point.

The breaking means may comprise a first arm connected to the first fixation point, a second and a third arm hingedly connected to the first arm in a same hinging point, a fourth and a fifth arm respectively hingedly connected to the second and third arm, the fourth and the fifth arm furthermore hingedly connected to a sixth arm in a hinging point, the sixth arm connected to the further fixation point.

It is an advantage of embodiments of the present invention that only the corners of the board partition break. Breaking of the corners already releases the rest of the board partition from seismic pressure. In case the seismic pressure increases even more firstly the already damaged board will break thereby protecting the rest of the board partition from breaking.

At least one of the corners of the board partition may be weaker than the remainder part of the boards so that, under stress, this at least one corner breaks earlier than the remainder part of the board partition.

It is an advantage of embodiments of the current invention that at least one of the corners breaks earlier than the rest of the board partition. When subjected to the same force, the at least one of the corners will break instead of the remainder part of the board partition or other boards as it is weaker.

The present invention also relates to a board partition comprising a seismic protective structure as described above.

According to a second aspect, a board partition is provided, which board partition, preferably a gypsum board partition comprises a seismic protective structure according to the first aspect of the invention.

According to some embodiments of the invention, the first and the second support element may be substantially vertically mounted. Substantially vertically means vertical plus or minus an angle of 5°.

According to some embodiments of the invention, the at least one board of the seismic protective structure may be weaker than the remainder part of the boards of the board partition. A first board being weaker than an other is to be understood as will the first board break under a force F1, applied perpendicular to the board surface the second board break under a force F2 applied perpendicular to the board surface, F1 being less than F2.

The present invention also relates, according to a third aspect, to a kit of parts for constructing a seismic protective structure according to the first aspect of the invention, the kit of parts comprises one or more of a track element, a first support element, at least one board, and a breaking system adapted for, when a given level of seismic stress is appearing, intentionally causing damage to the upper corner and/or lower corner of the board partition thereby releasing stress from the remainder of the board partition.

The present invention also relates, according to a fourth aspect, to a method for protecting a board partition against a given level of seismic stress, the method comprising using a seismic protective structure in the board partition according to the first aspect of the invention, such that, when a given level of seismic stress is appearing, damage is intentionally caused to an upper corner and/or lower corner of board partition of the seismic protective structure thereby releasing pressure from the remainder of the board partition.

The present invention further relates, according to a fifth aspect of the invention, to a method for restoring a board partition after an earthquake, the board partition comprising a seismic protective structure according to the first aspect of the invention. The method comprises replacing one or more of the board and a first support element for restoring the board partition.

Particular and preferred aspects of the invention are set out in the accompanying independent and dependent claims. Features from the dependent claims may be combined with features of the independent claims and with features of other dependent claims as appropriate and not merely as explicitly set out in the claims. These and other aspects of the invention will be apparent from and elucidated with reference to the embodiment(s) described hereinafter.

Figure 1:
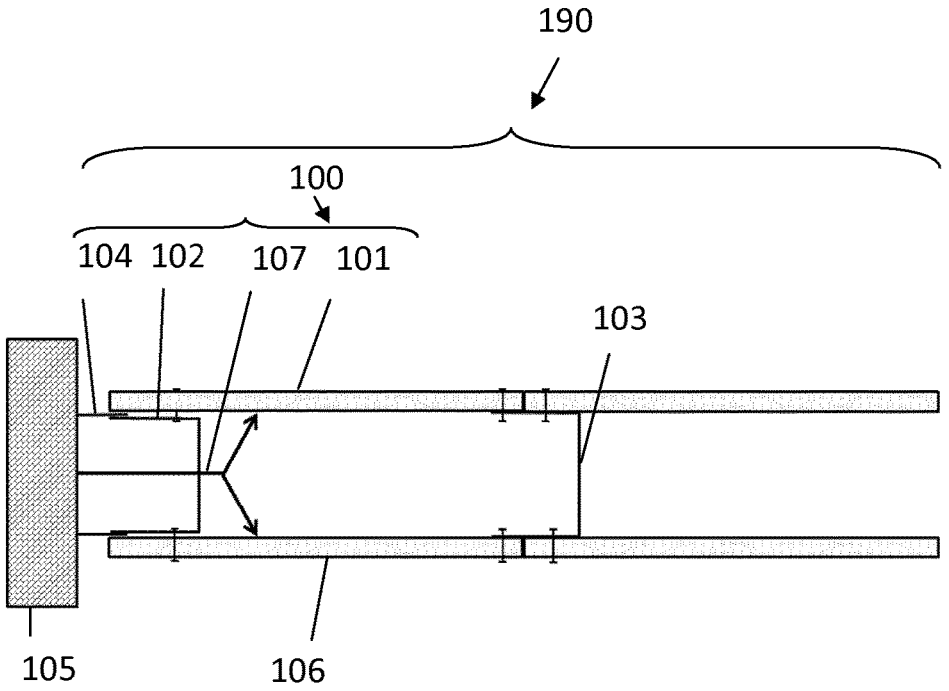
FIG. 1 provides a schematic top view of a system in between a wall and the rest of the board partition in accordance with embodiments of the present invention.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Where in embodiments of the present invention reference is made to damaging of a board, reference is made to breaking of the board, to pulling through of the fixing means through the board, etc.

Where in embodiments of the present invention reference is made to "a board partition", reference is made to a wall made by placing boards on an underlying structure. Such an underlying structure may be based on wood, on metal studs or any other sufficiently strong structural supporting elements.

Where in embodiments of the present invention reference is made to a "seismic protective structure", reference is made to part of the board partition which protects the rest of the board partition from breaking because of an earthquake.

Where in embodiments of the present invention reference is made to "the rest of the board partition" reference is made to all components of the board partition except for the components of the seismic protective structure.

In the first aspect, the present invention relates to a seismic protective structure for forming part of a board partition and for limiting damage to the board partition when a given level of seismic activity and thus seismic stress on the wall is appearing. In embodiments of the present invention this system is referred to as "the seismic protective structure" or "the mechanical fuse". The seismic protective structure thus is the part of the board partition that breaks because of seismic movements of the building.

In the first aspect, the present invention relates to a seismic protective structure for forming part of a board partition and for limiting damage to the board partition when a given level of seismic stress is appearing. The seismic protective structure comprises at least one board, a first substantially vertical support element for connecting the at least one board thereto and for positioning the at least one board at the of the board partition adjacent an adjacent wall neighboring the board partition. The system also comprises a track element being connectable to the adjacent wall neighboring the board partition, the track element being adapted for moveably positioning the first substantially vertical support element therein. The first support element and the track element thus are not fixedly connected to each other and can move with respect to each other. The system also comprises a second substantially vertical support element for linking the at least one board with the remainder of the board partition. The seismic protective structure furthermore comprises a breaking mechanism introduced in the proximity, i.e. adjacent or near, an upper corner and/or lower corner of the board. The breaking mechanism is adapted for, when a given level of seismic stress is appearing, intentionally causing damage to the upper corner and/or lower corner of the board partition thereby releasing stress from the remainder of the board partition.

By way of illustration, embodiments of the present invention not limited thereby, standard and optional details of the system and of standard and optional components thereof will further be described with reference to a number of drawings. Whereas in the following embodiments reference will be made to a gypsum board partition and gypsum boards, embodiments of the present invention are not limited thereto and can equally applied with or to board partitions constructed based on other board materials.

According to embodiments of the present invention, as illustrated in FIG. 1, the gypsum board 101 is fixed to a first support element 102 which is guided by a track element 104 which is connected to the exterior wall 105, i.e. the wall adjacent the gypsum board partition. In embodiments of the present invention the track element 104 and the first support element 102 can move with respect to each other. They can be inserted in each other or alternatively be integrated into one piece. In embodiments of the present invention the seismic protective structure 100 is connected with the rest of the gypsum board partition by means of the second support element 103. In embodiments of the present invention a breaking mechanism 107 is positioned adjacent to the upper and/or lower corner of the gypsum board. When the exterior wall 105 moves because of an earthquake, the breaking mechanism, by means of a force exercising means, will exercise a force on the corner(s) of the gypsum board causing the corner of the board partition to break or gypsum boards to separate from each other. On each side of the first support element an gypsum board might be present as illustrated in an the exemplary embodiment of FIG. 1. In exemplary embodiments of the present invention a breaking mechanism is positioned in each corner of the gypsum board partition 190. The breaking mechanism applies, by the force exercising means and when moving in the direction of the gypsum board because of an earthquake, a force on the corners of the gypsum board which is substantially orthogonal to the gypsum board. In embodiments of the present invention the angle between the force and an axis orthogonal to the gypsum board 101 is varying between 50° and 0°, e.g. between 40° and 0°, e.g. between 30 and 0°, e.g. between 20 and 0°, e.g. between 10 and 0°, e.g. 0°. It is an advantage of embodiments of the present invention that the rest of the gypsum board partition is prevented from being damaged by the breaking of the corner(s) of the board partition. Breaking of the seismic protective structure 100 results in releasing the pressure from the rest of the gypsum board partition.

Figure 2:
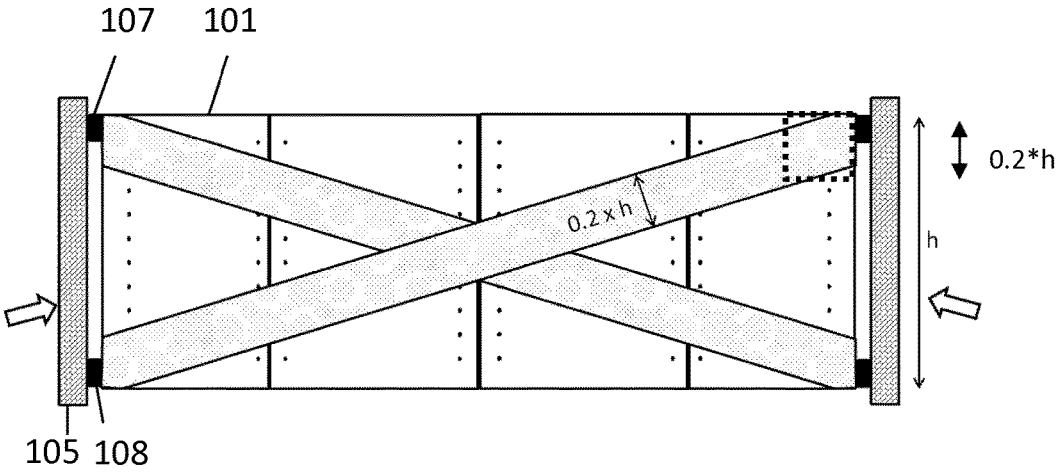
FIG. 2 provides a schematic front view of a board partition and the zones where stresses typically are built up during seismic activity, as is used in embodiments of the present invention.
Figure 3:
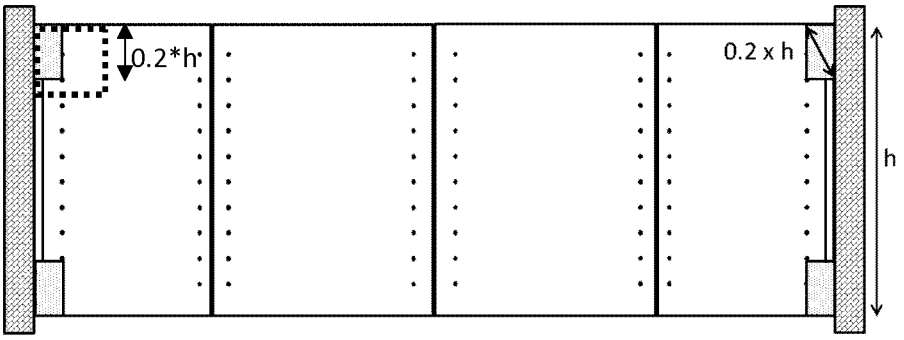
FIG. 3 provides in a schematic front view of a board partition wherein the areas in the corners of the board partition which have a higher seismic pressure, as is used in embodiments of the present invention.
Figure 4:
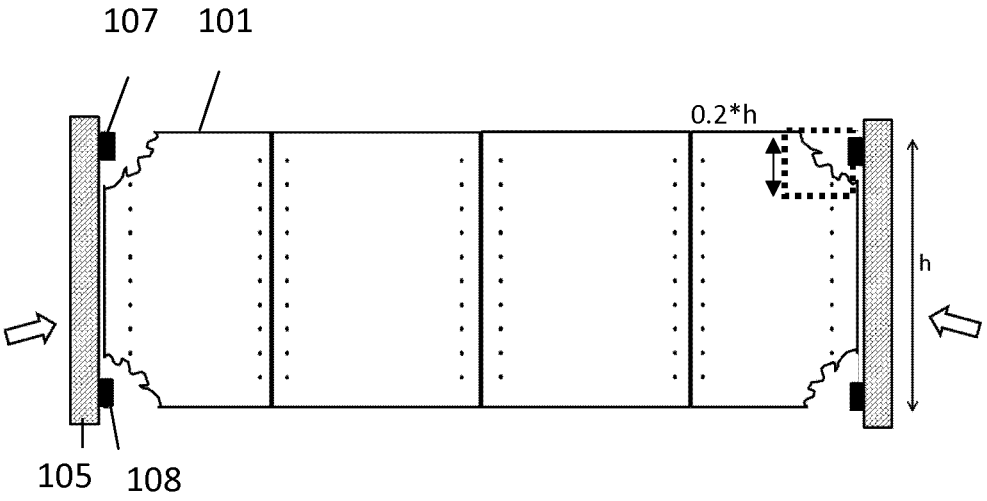
FIG. 4 provides a schematic front view of a board partition with broken corners at the boards, in accordance with an embodiment of the present invention.

FIG. 2 and FIG. 3 illustrates the seismic pressure distribution in a gypsum board partition during an active earthquake, as was validated through simulations and tests. The breaking mechanisms are adapted to cause damage in a square zone of the board partition, the sides of the square zones being equal to 0.2*H, H being the maximum height of the board partition. The seismic pressure is dominantly present in the diagonals of the gypsum board partition. The width of the diagonal regions with an increased seismic pressure equals 0.2×h whereby h equals the height of the gypsum board partition. The height can be varying between 1 and 30 meter, preferably between 2 and 15 meter. In embodiments of the current invention the breaking mechanism ensures that it are the corners of the board partition, of which the areas are defined by the diagonals with length 0.3×h or smaller, e.g. 0.2×h as illustrated in FIG. 2, which break first. The area of the corner of the board partition is defined as a rectangular area, in a corner of the gypsum board partition, with a diagonal orthogonal to a diagonal of the gypsum board partition and with a length smaller than 0.3×h, e.g. 0.2×h. As illustrated in FIG. 4, after breaking of the corners, the seismic pressure is released from the rest of the gypsum board partition. If the earthquake level would increase, the already damaged gypsum boards will break first as they are already weaker. Thereby releasing pressure from the rest of the gypsum board partition.

The protective structure can be obtained in a number of different embodiments, all resulting in the fact that the corners of the gypsum boards in the seismic protective structure will break first, thus releasing the stress or pressure on the rest of the gypsum board partition.

Figure 5:
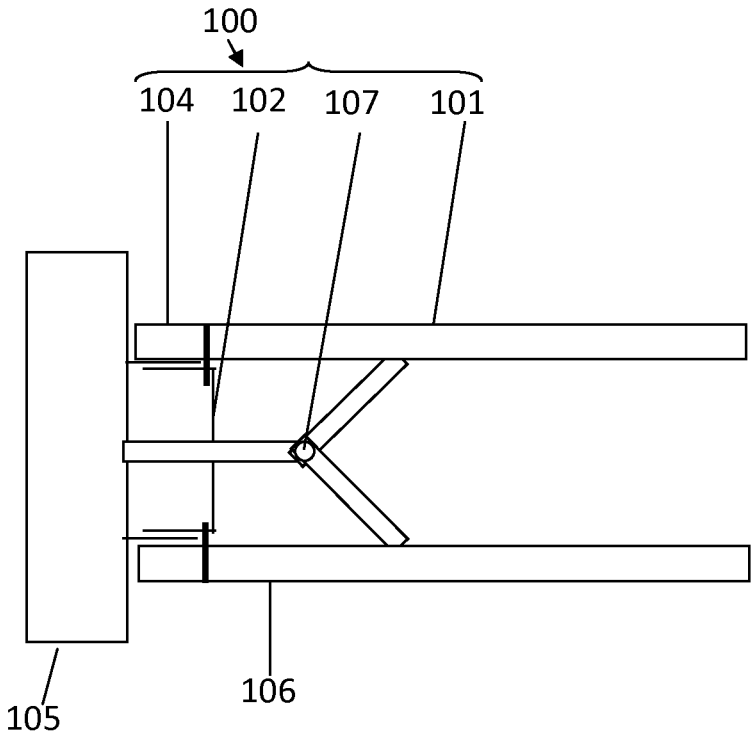
FIG. 5 provides a schematic top view of a system with an exemplary expanding system in accordance with embodiments of the present invention.
Figure 6:
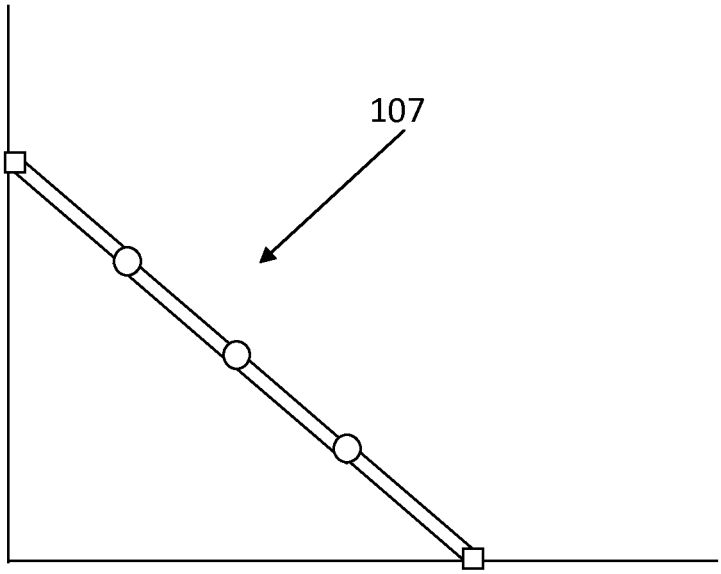
FIG. 6 and FIG. 7 provides a schematic front view and side view of a system with another exemplary expanding system in accordance with embodiments of the present invention.
Figure 7:
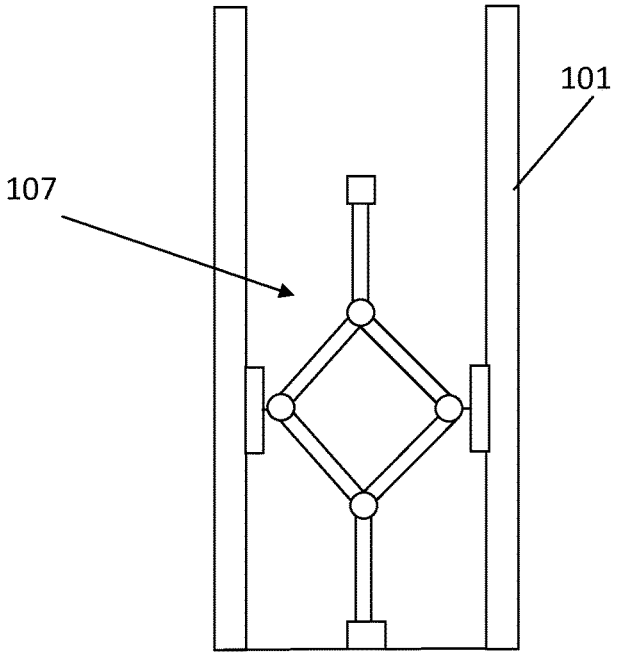

In a first set of embodiments, the present invention relates to a seismic protective structure as described above, wherein the breaking mechanism 107 expands when the wall 105 of the building moves in the direction of the gypsum board partition. Examples of such systems are shown in FIG. 5 to FIG. 7. The breaking mechanism 107, which is to exercise a force hence is a force exercising means, which is located in the upper and/or lower corner, thereby breaks the upper and/or lower corner of the board partition. In an exemplary embodiment, as shown in FIG. 5, the breaking mechanism is Y-shaped, and opens up to a T-shaped form when there is seismic activity of a given level, whereby the wall 105 of the building moves in the direction of the gypsum board 101. The breaking means comprises a first arm which typically is fixed at one side to the track element 104 in a first fixation point. The breaking mechanism also comprises two further arms, hingedly connected in the other end point of the first arm. The two further arms are at their other side connected to two opposing gypsum boards in further fixation points. When a given level of seismic stress is appearing, the rotatable arms are expanding due to forces induced on the breaking means between the different fixation points. In that case the breaking mechanism 107 breaks the opposite upper and/or lower corners of both boards of the board partition. FIG. 5 illustrates the situation before an earthquake. After the earthquake, the corners of both boards of the board partition are broken.

In a further exemplary embodiment, as shown in front view and side view in respectively FIG. 6 and FIG. 7, the breaking mechanism 107 comprises a number of hingedly linked arms. The breaking mechanism typically may be fixed at the end points. It may be fixed at one side to the track element 104 in a first fixation point and at another side to a bottom or top part of the gypsum board partition in a further fixation point. This causes the system, when a given level of seismic stress is appearing, to induce a rotation of the rotatable arms, thus expanding due to forces induced on the breaking mechanism between the first fixation point and the further fixation point. More particularly, the breaking means may comprise a first arm connected to the first fixation point, a second and a third arm hingedly connected to the first arm in a same hinging point, a fourth and a fifth arm respectively hingedly connected to the second and third arm, the fourth and the fifth arm furthermore hingedly connected to a sixth arm in a hinging point, the sixth arm connected to the further fixation point. When pressure is induced the second and third arm fold open, as well as the fourth and the fifth arm, thus resulting in these arms inducing pressure on the corners of the gypsum board, resulting in breaking of the corners of the board partitions.

In embodiments of the current invention the corners of the gypsum board partitions break caused by an earthquake, the seismic pressure is relieved from the rest of the gypsum board partition. In case the seismic pressure increases further the already damaged board partition will break completely, thereby creating a gap and releasing the pressure further. It is an advantage of embodiments of the current invention that breaking of the corners is for earthquakes up to a certain level sufficient to protect the rest of the gypsum board partition from breaking. It is an advantage of embodiments of the current invention that in case the earthquake level increases the gypsum board partition 101 breaks completely thereby creating a gap which protects the rest of the gypsum board partition from breaking. It is an advantage of embodiments of the current invention that only the seismic protective structure 100 needs to be replaced in case of breaking after an earthquake.

In some embodiments of the present invention, the corners may be made of a weaker material the rest of the gypsum board. During an earthquake the seismic pressure increases more in the diagonals of the gypsum board partition. Since the corners are included in these regions of higher pressure, i.e. in the diagonal regions, they will break first. The latter is assisted when the corners are of a weaker material. Instead of using weaker material, in embodiments of the current invention the corners are made weaker by introducing a fissure in them.

In some embodiments of the current invention the gypsum board may be made of the same material as the other gypsum boards used in the partition wall. It is an advantage of embodiments of the current invention that standard available board materials can be used.

As indicated, the board may be an edge board but does not need to be. In some embodiments, the system also may be introduced at another position—away from the edge of the partition board—in the partition board for breaking a board at that other position preferentially over the other boards. Except for the change in position, the same principles and features apply.

In a second aspect, the present invention relates to a gypsum board partition wall comprising a seismic protective structure as described in the first aspect. In advantageous embodiments, the gypsum board partition may comprise a seismic protective structure at both ends of the gypsum board partition. It is an advantage of embodiments of the current invention that the gypsum board partition comprising the protective structure separates two rooms effectively with regard to fire and with regard to acoustics. Since the gypsum board partition comprising the protective structure completely separates a place into two places no issue exists with regard to of fire safety and acoustic.

In a third aspect, the present invention relates a kit of parts for constructing or restoring a seismic protective structure as described above. The kit of parts comprises one or more of a track element, a first support element, at least one gypsum board and a breaking mechanism. The breaking mechanism thereby is adapted for, when a given level of seismic stress is appearing, intentionally causing damage to the upper corner and/or lower corner of the gypsum board partition thereby releasing stress from the remainder of the gypsum board partition.

In still another aspect, the present invention relates to a method for protecting a gypsum board partition against a given level of seismic stress, the method comprising using a seismic protective structure in the gypsum board partition such that, when a given level of seismic stress is appearing, damage is intentionally caused to an upper and/or lower corner of the at least one gypsum board of the seismic protective structure thereby releasing pressure from the remainder of the board partition. Furthermore also a method for restoring a gypsum board partition is disclosed, wherein the method comprises replacing one or more of the gypsum board and a first support element for restoring the gypsum board partition.

Figure 8:
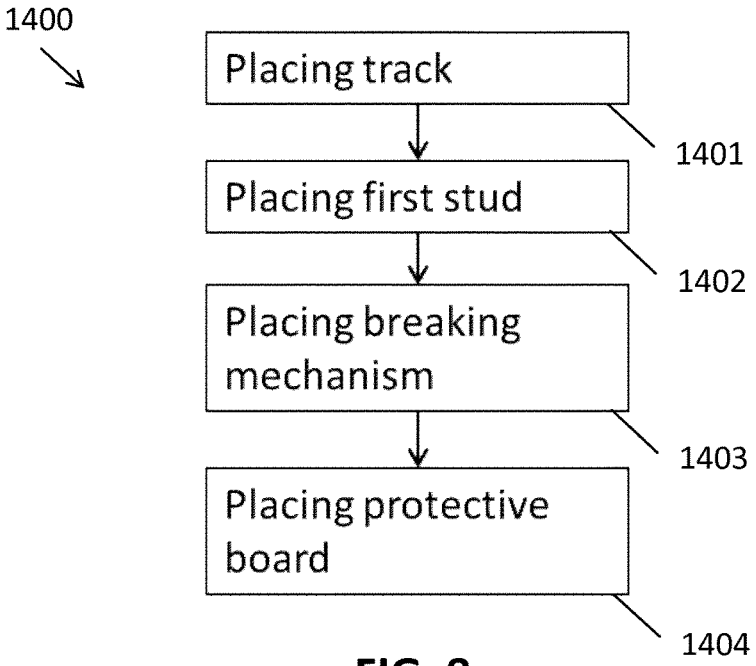
FIG. 8 provides a flow chart illustrating the steps of a method in accordance with embodiments of the current invention.

By way of illustration, an exemplary method 1400 for completing a gypsum board partition 190 is shown in FIG. 8. The method 1400 comprises a first step 1401 of placing a track element 104 against a wall 105 of a building, a second step 1402 of placing a first support element 101, whereby the first support element may be fixable to or guidable in a track element 104. In some embodiments the first support element and track element might even be integrated.

In a third step 1403, a breaking mechanism 107 is placed at the upper and/or lower side of the track element 104, and as a final step, one or more gypsum boards 101 are positioned against the first stud 102 and a second stud 103. The second stud 103 links the protective structure 100 with the rest of the gypsum board partition.

The invention claimed is:

1. A seismic protective structure (100) for forming part of a board partition (190), the seismic protective structure (100) comprising:

at least one board (101), a first support element (102) for connecting the at least one board (101) thereto and for positioning the at least one board (101) such that said board provides at least one of an upper corner and a lower corner of the board partition adjacent an adjacent wall neighboring the board partition, a track element (104) being connectable to the adjacent wall neighboring the board partition (190), the track element (104) being adapted for moveably positioning the first support element (102) therein, a second support element (103) for linking the at least one board (101) with the remainder of the board partition (190), the seismic protective structure comprising at least one breaking mechanism (107) located adjacent said upper corner and/or lower corner of the board partition provided by said at least one board, wherein the breaking mechanism (107) is adapted for, when a given level of seismic stress is appearing, intentionally causing damage to the at least one board at said upper corner and/or lower corner of the board partition, thereby releasing stress from the remainder of the board partition (190).

2. A seismic protective structure (100) according to claim 1, wherein said at least one board provides both the upper corner and lower corner of the board partition adjacent an adjacent wall neighboring the board partition.

3. A seismic protective structure (100) according to claim 1, wherein the seismic protective structure comprises at least a first and a second board, said first board providing the upper corner of the board partition adjacent an adjacent wall neighboring the board partition, said second board providing said lower corner of the board partition adjacent an adjacent wall neighboring the board partition.

4. A seismic protective structure (100) according to claim 1, wherein the seismic protective structure comprises at least a first and a second breaking mechanism, said first breaking mechanism is adapted for, when a given level of seismic stress is appearing, intentionally causing damage to the at least one board at said upper corner of the board partition, said second breaking mechanism is adapted for, when a given level of seismic stress is appearing, intentionally causing damage to the at least one board at said lower corner of the board partition thereby releasing stress from the remainder of the board partition (190).

5. A seismic protective structure (100) according to claim 1, wherein each of the at least one breaking mechanisms is adapted to cause damage in a square zone of the board partition, said square zone having as one of its corners one of the upper and lower corner of said board partition, and a side equal to 0.2*H, H being the maximum height of said board partition.

6. A seismic protective structure (100) according to claim 5, wherein each of the at least one breaking mechanisms is adapted to cause damage in a square zone of the board partition, said square zone having as one of its corners one of the upper and lower corner of said board partition, and a side equal to $0.2*H/\sqrt{2}$, H being the maximum height of said board partition.

7. A seismic protective structure (100) according to claim 1, wherein said one or more breaking mechanism comprises a force exercising means suitable for exercising a force to the board, the angle between the force exercised and an axis orthogonal to the surface of the board being in the range of 50° to 0°, said force exercising means being adapted for triggering the exercising of said force when a given level of seismic stress is appearing on the board partition.

8. A seismic protective structure (100) according to claim 1, wherein the breaking mechanism (107) comprises an expansion means for expanding and introducing stress at the upper corner and/or lower corner of the board partition, said expansion means being adapted for triggering the expanding when a given level of seismic stress is appearing on the board partition.

9. A seismic protective structure (100) according to claim 8, wherein the expansion means comprises rotatable arms orienting in a direction perpendicular to the at least one board partition when a given level of seismic stress is appearing on the board partition wall.

10. A seismic protective structure (100) according to claim 9, wherein the breaking means is fixed at one side to the track element (104) in a first fixation point and at two opposing boards in further fixation points, so that, when a given level of seismic stress is appearing, the rotatable arms are expanding due to forces induced on the breaking means between the different fixation points.

11. A seismic protective structure (100) according to claim 10, wherein the breaking means comprises a first arm connected to the first fixation point and a second and third arm hingedly connected to the first arm in a same hinging point, the second and the third arm respectively connected to the opposing boards in the further fixation points.

12. A seismic protective structure (100) according to claim 9, wherein the breaking means is fixed at one side to the track element (104) in a first fixation point and at another side to a bottom or top part of the board partition wall in a further fixation point, so that, when a given level of seismic stress is appearing, the rotatable arms are expanding due to forces induced on the breaking means between the first fixation point and the further fixation point.

13. A seismic protective structure (100) according to claim 12, wherein the breaking means comprises a first arm connected to the first fixation point, a second and a third arm hingedly connected to the first arm in a same hinging point, a fourth and a fifth arm respectively hingedly connected to the second and third arm, the fourth and the fifth arm furthermore hingedly connected to a sixth arm in a hinging point, the sixth arm connected to the further fixation point.

14. A seismic protective structure (100) according to claim 1, wherein said at least one board partition is a gypsum board partition.

15. A seismic protective structure (100) according to claim 1, wherein the first and second support elements are substantially parallel.

16. A board partition (190) comprising a seismic protective structure according to claim 1.

17. A board partition according to claim 16, wherein said first and said second support element (102, 103) are substantially vertically mounted.

18. A board partition according to claim 16, wherein said at least one board of said seismic protective structure is weaker than the remainder part of other boards of the board partition.

19. A kit of parts for constructing a seismic protective structure according to claim 1, the kit of parts comprises one or more of a track element (104), a first support element (102), at least one board (101), and a breaking system (107) adapted for, when a given level of seismic stress is appearing, intentionally causing damage to the upper corner and/or lower corner of the board partition thereby releasing stress from the remainder of the board partition (190).

20. A method for protecting a board partition (190) against a given level of seismic stress, the method comprising using a seismic protective structure (100) according to claim 1 in the board partition such that, when a given level of seismic stress is appearing, damage is intentionally caused to an upper corner and/or lower corner of board partition of the seismic protective structure (100) thereby releasing pressure from the remainder of the board partition (190).

21. A method for restoring a board partition after an earthquake, the board partition comprising a seismic protective structure according to claim 1, the method comprising replacing one or more of the at least one board and the first support element for restoring the board partition.

* * * * *